US011612934B2

(12) United States Patent
Seeliger

(10) Patent No.: US 11,612,934 B2
(45) Date of Patent: Mar. 28, 2023

(54) METHOD FOR PRODUCING A SEMI-FINISHED PRODUCT FOR A COMPOSITE MATERTAL

(71) Applicant: POHLTEC METALFOAM GMBH, Cologne (DE)

(72) Inventor: Wolfgang Seeliger, Saarbrucken (DE)

(73) Assignee: Pohltec Metalfoam GmbH, Cologne (DE)

( * ) Notice: Subject to any disclaimer, the term of this patent is extended or adjusted under 35 U.S.C. 154(b) by 387 days.

(21) Appl. No.: 16/646,773

(22) PCT Filed: Sep. 14, 2018

(86) PCT No.: PCT/EP2018/074888
§ 371 (c)(1),
(2) Date: Jun. 2, 2020

(87) PCT Pub. No.: WO2019/053192
PCT Pub. Date: Mar. 21, 2019

(65) Prior Publication Data

US 2020/0298307 A1 Sep. 24, 2020

(30) Foreign Application Priority Data

Sep. 15, 2017 (DE) ..... 10 2017 121 511.5

(51) Int. Cl.
*B22F 3/11* (2006.01)
*B22F 7/00* (2006.01)
*C22C 1/04* (2006.01)

(52) U.S. Cl.
CPC ..... *B22F 3/1125* (2013.01); *B22F 7/006* (2013.01); *C22C 1/0416* (2013.01); *B22F 2301/052* (2013.01)

(58) Field of Classification Search
CPC .. B22F 3/1125; B22F 7/006; B22F 2301/052; C22C 1/0416
See application file for complete search history.

(56) References Cited

U.S. PATENT DOCUMENTS

2004/0209107 A1* 10/2004 Schwingel ..... B32B 15/01 419/8

FOREIGN PATENT DOCUMENTS

EP 3165307 A1 5/2017
WO 03009956 A2 2/2003

OTHER PUBLICATIONS

Zhang et al. ("The Influence of Titanium Hydride Pretreatment on the Compressive Properties of Aluminum Foam." Materials Science 20.4 (2014): 424-428.) (Year: 2014).*

(Continued)

*Primary Examiner* — Anthony J Zimmer
*Assistant Examiner* — Ricardo D Morales
(74) *Attorney, Agent, or Firm* — Dinsmore & Shohl LLP

(57) ABSTRACT

The invention relates to a method for producing a semi-finished product comprising a foamable core comprising a foamable mixture that comprises at least one first metal having an aluminum content of at least approximately 80 wt. %, in relation to the quantity of the at least one first metal, and at least one foaming agent, wherein a layer of at least one second metal in the form of a non-foamable solid material and with an aluminum content of at least approximately 80 wt. %, in relation to the quantity of the at least one second metal, is respectively applied to at least one first and second surface of the core. The invention also relates to a corresponding semi-finished product and to the use of such a semi-finished product for foaming a metal.

15 Claims, 1 Drawing Sheet

(56) References Cited

OTHER PUBLICATIONS

Figure 1:
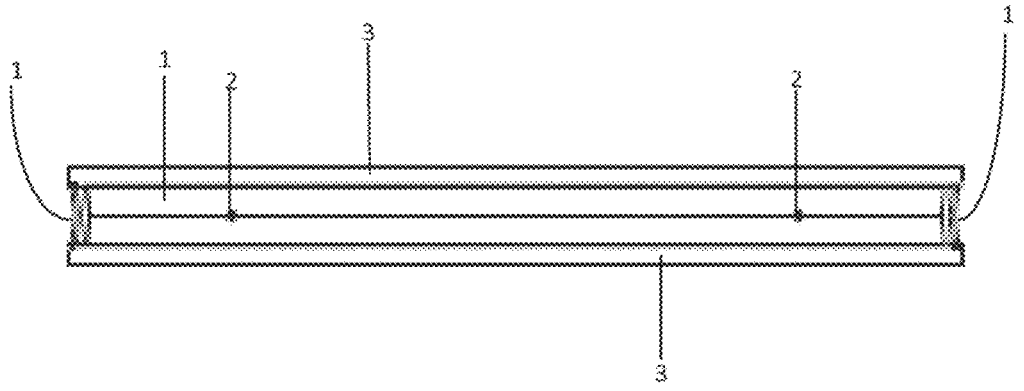

Kennedy et al. ("The decomposition behavior of as-received and oxidized TiH2 foaming-agent powder." Materials Science and Engineering: A 357.1-2 (2003): 258-263.) (Year: 2003).*
Abdallah et al. ("Effect of Applying Hot Isostatic Pressing on the Microstructure and Mechanical Properties of Tungsten Heavy Alloys." International Conference on Aerospace Sciences and Aviation Technology. vol. 17. No. Aerospace Sciences & Aviation Technology, ASAT-17—Apr. 11-13, 2017. (Year: 2017).*
Miatijasevic-Lux et al., Modificaiton of Titanium Hydride For Improved Aluminum Foam Manufacture, Acta Materialia 54 (2006) pp. 1887-1900, Published by Elsevier Ltd., Dec. 12, 2005.
Zhang et al., The Influence of Titanium Hudride Pretreatment On The Compressive Properties of Aluminum Foam, Materials Science (Medziagotyra), vol. 20, No. 4, 2014, ISSN 1392-1320.

* cited by examiner

METHOD FOR PRODUCING A SEMI-FINISHED PRODUCT FOR A COMPOSITE MATERTAL

The present invention relates to a method for producing a semi-finished product comprising a foamable core which comprises a foamable mixture comprising at least one first metal having an aluminum content of at least approximately 80 wt. %, in relation to the quantity of the at least one first metal, and at least one foaming agent, wherein a layer of at least one second metal in the form of non-foamable solid material and having an aluminum content of at least approximately 80 wt. %, in relation to the quantity of the at least one second metal, is applied to each of at least one first and one second surface of the core. Furthermore, the invention relates to a corresponding semi-finished product and the use of such a semi-finished product for foaming metal.

Metal foam sandwiches have been known for years. They are of particular interest if the composite is a single-material system, i.e. if a certain metal and its alloys are used, in particular aluminum and its alloys, and the connection between core and cover layer is created by means of a metallurgical bond. Corresponding methods for producing such composite materials and components made from them are known from various publications.

DE 44 26 627 C2 describes a method in which one or more metal powders are mixed with one or more foaming agent powders, and the powder mixture thus obtained is compressed by means of axial hot pressing, hot isostatic pressing or rolling and, in a subsequent operation, is joined to previously surface-treated metal sheets by roll cladding to form a composite material. After forming the resultant semi-finished product, for example by pressing, deep-drawing or bending, the semi-finished product is heated in a final step to a temperature which is in the solidus-liquidus range of the metal powder, but below the melting temperature of the cover layers. Since the foaming agent powder is selected in such a way that in this temperature range its gas separation takes place simultaneously, pores are formed within the viscous core layer, accompanied by a corresponding increase in volume. The foamed core layer is stabilized by the subsequent cooling of the composite.

In a modification of the method known from DE 44 26 627 C2, in which the powder pressed part is already formed with closed pores, EP 1 000 690 A2 describes the production of such a composite material on the basis of a powder pressed part which is initially produced with open pores and only becomes closed-pored with the cover layers during subsequent roll cladding. The other method steps are identical. The original open porosity is intended to prevent any gas separation of the foaming agent that occurs during storage of the powder pressed part from causing changes in the geometry of the pressed part and thus problems in the later production of the composite with the cover layers. Furthermore, the open porosity should facilitate the break-up of the oxide layers that form during storage of the pressed part during the production of the composite.

DE 41 24 591 C1 discloses a method for producing foamed composite materials, wherein the powder mixture is filled into a hollow metal profile and is then rolled together with it. The forming of the resultant semi-finished product and the subsequent foaming process are carried out in the same way as described in DE 44 26 627 C2.

EP 0 997 215 A2 discloses a method for producing a metallic composite material consisting of solid metallic cover layers and a closed-pore, metallic core to be removed, which combines the production of the core layer and the bonding with the cover layers in one step by introducing the powder mixture into the roll gap between the two cover layers and thus compressing it between them. It is also proposed to supply the powder in an inert gas atmosphere in order to thus prevent the formation of oxide layers which could negatively affect the required bond between the cover layers and the powder mixture.

In a further method for producing such a composite material, known from DE 197 53 658 A1, the process steps, on the one hand, of producing a bond between core and cover layers and, on the other hand, of foaming are combined by placing the core in the form of a powder pressed part between the cover layers in a mold and only bonding it to them during the foaming process. Due to the compressive force applied by the core during foaming, the cover layers are simultaneously subjected to a deformation corresponding to the mold surrounding them.

From U.S. Pat. No. 5,972,521 A, a method is known for the production of a composite material blank in which air and moisture are removed from the powder by evacuation. The evacuated air is then replaced by a gas that is inert to the core material and that is under increased pressure, more specifically before the powder is compressed and bonded to the cover layers.

EP 1 423 222 discloses a method for producing a composite of cover layers and metal powder, in which the entire production process takes place under vacuum. In particular, the compression of the bulk powder and the subsequent rolling should be carried out under vacuum.

All of these methods known from the prior art, except for EP 1 423 222, have the common feature that, by producing the core layer to be foamed, air or inert gas is trapped between the metal powder particles during the compaction and is compressed depending on the degree of compaction. The resulting gas pressures, which increase even further when the temperature is raised during the foaming process, lead to the formation of pores during heating even before the temperature corresponding to the solidus-liquidus range of the metal powder material is reached. In contrast to the closed, spherical pores that occur in the solidus-liquidus range of the metal powder as a result of the outgassing of the foaming agent powder and that are sought by means of this method, the pores here are open, crack-like interconnected and irregularly shaped pores. While, for example, a method is known from U.S. Pat. No. 5,564,064 A1 which specifically aims to achieve such open porosity by expansion of enclosed gases below the melting point of the powder material, such a pore formation is not desirable in the previously described methods, since only the sought closed, spherical pores allow an optimum load transfer via the cell walls surrounding the pores and as intact as possible, and thus contribute significantly to the strength of the core foams and thus of the composite material.

DE 102 15 086 A1 discloses a method for producing foamable metal bodies by compacting a semi-finished product. The gas-separating foaming agent is formed here from powdery or liquid metal-containing foaming agent primary material, such as titanium for example, which is treated with a liquid or gaseous non-metal-containing foaming agent primary material, such as a hydrogenating agent, in particular H2 gas for example, however the foaming agent primary material is already present in a compacted semi-finished product in a mixture with the metal to be foamed, such as aluminum. Although a pre-compression of the mixture by means of cold isostatic pressing, hot isostatic pressing, axial pressing or powder rolling is provided for, the actual foaming agent is only then formed by hydrogenation of the mixture of metal-containing foaming agent primary material and the at least one metal.

BR 10 2012 023361 A2 discloses uniaxial compacting and pressing in the production of a semi-finished product for a closed-pore metal foam, wherein the semi-finished product contains a metal selected from the group consisting of Al, Zn, Mg, Ti, Fe, Cu and Ni, and a foaming agent selected from the group consisting of $TiH_2$, $CaCO_3$, $K_2CO_3$, $MgH_2$, $ZrH_2$, $CaH_2$, $SrH_2$ and $HfH_2$ and others.

WO 2007/014559 A1 discloses a method for the powder metallurgical production of metal foam, in which a powdery metallic material is pressed without foaming agent to form a dimensionally stable semi-finished product and is then foamed in a chamber, closed pressure-tight, by reducing the ambient pressure.

In DE 199 33 870 01, a method for producing a metallic composite material body using a foamable pressed part is presented, wherein the pressed part or the semi-finished product is produced by compressing a mixture of at least one metal powder and at least one gas-separating foaming agent powder, wherein a sandwich structure can be achieved by providing the pressed part with cover layers by cold or hot rolling or diffusion welding.

U.S. Pat. No. 6,391,250 uses a foamable semi-finished product which is obtained by powder metallurgical production methods. The starting product for the production of aluminum foam moldings is, for example, a powder mixture of aluminum or an aluminum alloy, homogeneously mixed with a foaming agent, preferably titanium hydride, and possibly other powder additives. The mixture is compressed, for example by pressing, extrusion, rolling or in a comparable manner, to produce piece goods, i.e. rods, plates, profiles or similar semi-finished products, preferably achieving a density of the semi-finished product of more than approximately 95% of the theoretical density of the metal matrix.

US 2004/0081571 A1 concerns a method for producing metal chips, comprising the steps: (i) providing a mixture of a metal alloy powder with a foaming agent powder or foaming agent powder; (ii) pre-compressing the mixture from step (i); (iii) heating the pre-compressed mixture from step (ii) to a temperature which is below the decomposition temperature of the foaming agent and at which permanent bonding of the particles can take place; (iv) hot compressing the mixture obtained in step (iii) to produce a compressed body of a metal matrix embedding the foaming agent; and (v) crushing the compressed body into metal fragments and thereby obtaining foamable metal chips.

EP 0 945 197 A1 discloses a method for producing formable composite sheets or strips in sandwich structure, wherein blocks consisting at least partially of a foaming agent-containing aluminum alloy are used. These blocks are pressed, i.e. no longer contain any powder, with foreign gases also being compressed; they are extruded into formats with a rectangular rolling ingot cross-section, which are clamped and hooked together on their narrow sides to form large-format composite sheets and then provided with a uniform cover layer by roll cladding. The composite sheets or strips produced from the clad rolling ingot formats are formed and then foamed under the action of pressure and temperature. Disadvantages known from the prior art are semi-finished products that cannot be foamed homogeneously, i.e. without defects; instead, foaming often results in dents and bulges, which make it difficult or impossible to use the foamed products as composite materials in precisely manufactured components, for example in automotive or aircraft construction. This is often due to the fact that the semi-finished products themselves already have manufacturing defects and inhomogeneities such as trapped foreign gases or moisture or inhomogeneous distribution of the metal and foaming agent powders and/or the semi-finished products contain unsuitable foaming agents which develop the foaming gas too early later in the foaming process and thereby form defects, i.e. excessively large cavities of varying and largely uncontrollable size, which are also often open-pored and thus lead to instabilities in the structure of the metal foam formed. Finally, the known manufacturing methods for semi-finished products are either not suitable for sandwich structures, i.e. semi-finished products with a foamable core and solid metallic cover layers on top of it, or involve too many steps and are therefore too complex.

The object of the present invention is thus to provide an improved method suitable for producing a foamable primary material that is likewise improved, also referred to as a semi-finished product, consisting of solid metallic cover layers and a foamable core material arranged in between. The semi-finished product shall be suitable for the production of a composite material as well as components ultimately produced therefrom consisting of solid metallic cover layers and a closed-pore metal foam core arranged in between.

The aim is to produce a virtually defect-free foamable metal core in as few method steps as possible, which is suitable for the subsequent production of a virtually defect-free foamed metal core. The method should therefore be able to manage with as few process steps as possible. The composite of cover layer and core resulting from this method can then be foamed into a sandwich or composite material.

Surprisingly, it has been found that a metal container or a container or receptacle with at least two metal walls is particularly well suited for the production of a corresponding semi-finished product with a layered, sandwich-like structure, i.e. with a foamable (expandable) core and solid metallic cover layers, i.e. made of non-foamable solid material, on at least two sides of the core. In this case, at least two side faces of the container, i.e. for example the base and lid of the container, are formed by the solid, i.e. non-foamable, solid metallic cover layers.

Furthermore, it has been found surprisingly that, with regard to the further processability to the semi-finished product, both for the core and the cover layers, especially those metals or metal alloys are suitable which have an aluminum content of at least approximately 80 wt. % (weight percent or wt. %) aluminum, in relation to the metal or metal alloy. Finally, it was surprisingly found that the mixing of the components required for foaming a metal, i.e. in particular the metal to be foamed and the foaming agent, to form the foamable mixture is an important factor influencing the quality, i.e. in particular the homogeneity and stability of the metal foam later formed from it: the better the mixing of the components of the foamable mixture, the better the quality of the metal foam obtained therefrom.

The object forming the basis of the invention is therefore achieved by using a mixture of metal powder and foaming agent powder which is as homogeneous as possible and filling it into such a container or vessel. For this purpose, a mixture of metal powder and foaming agent powder (gas-separating powder) is filled into a container, the bottom and lid of which form the later cover layers or top layers of the composite.

The present invention therefore provides (A) a method for producing a semi-finished product comprising a foamable core which comprises a foamable mixture comprising at least one first metal having an aluminum content of at least approximately 80 wt. %, in relation to the quantity of the at least one first metal, and at least one foaming agent, wherein a layer of at least one second metal in the form of non-foamable solid material and having an aluminum content of at least approximately 80 wt. %, in relation to the quantity of the at least one second metal, is applied to each of at least one first and one second surface of the core, the method comprising the steps of
  (I) providing a container comprising the aforesaid layer of the at least one second metal as defined above on the at least one first and second surfaces of the container,
  (II) providing a powder comprising powder particles of the at least one first metal,
  (III) providing a powder comprising powder particles of the at least one foaming agent, and
  (IV) filling the container with the powders provided in steps (II) and (III) to form the foamable core, wherein the powders provided in steps (II) and (III) are mixed to form the foamable mixture;

(B) a semi-finished product obtainable by a method as defined under (A);

(C) a semi-finished product comprising a foamable core which comprises a foamable mixture, wherein the foamable mixture comprises a powder comprising powder particles of at least one first metal, as defined herein, and a powder comprising powder particles of at least one foaming agent, as defined herein, wherein a layer of at least one second metal, as defined herein, is applied to at least one first and one second surface of the core: and (D) the use of a semi-finished product as defined under (B) or (C) for foaming metal, in particular for producing a composite material comprising metal foam and metal in the form of non-foamable solid material; and (E) a container for carrying out the method according to the invention, having a first and a second surface forming a bottom and a lid, and side walls, wherein at least one side wall has an inward buckling in the direction of a foamable mixture.

The invention thus relates to a method for producing a semi-finished product suitable for producing a metallic composite material primarily from aluminum and its alloys, consisting of solid metallic cover layers and a metallic core foamed in between, which together form a sandwich or metal foam sandwich. This composite is produced from the cover layers and a mixture of at least one metal powder introduced in between. This composite (semi-finished product) can, if necessary, be shaped to produce a component and then thermally treated in such a way that the gas separation of a foaming agent powder or a metal powder leads to the foaming of the core and the formation of a metallic composite material with a sandwich-like structure, i.e. in the form of a metal foam sandwich. However, the forming step can also be omitted. Furthermore, components can be produced from such a metallic composite material.

If, in the context of the invention, the term "approximately" or "substantially" is used in relation to values or ranges of values, or if the use of these terms results in certain values arising from the context (e.g. the phrase "an expansion of the container is substantially prevented" or similar may be understood to mean a change in volume, i.e. generally an increase or decrease in volume, of 0%), the term "approximately" or "substantially" shall be understood to mean what a person skilled in the art will consider to be usual practice in the given context. In particular, deviations of the stated values of +1-10%, preferably of +1-5%, more preferably of +/−2%, particularly preferably of +/−1% are covered by the terms "approximately" and "substantially,"

A semi-finished product within the meaning of the present invention comprises a foamable primary material which, after foaming, produces a composite material comprising a metal foam and solid metallic cover layers. The metal foam is provided here as a core or core material, i.e. metal foam core, between the solid metallic cover layers. The semi-finished product is thus suitable for the manufacture of a composite material and ultimately of components made of it, consisting of solid metallic cover layers and a metal foam core arranged in between, which is preferably closed-pored. The semi-finished product is, for example, planar, but it can also be formed from preferably such a planar form. Composite material in the sense of the present invention is a metallic material in which two structurally different materials, namely foamed metal (metal foam) and metal in the form of solid, non-foamable solid material are combined with each other and are connected with each other in an interlocking and/or integrally bonding manlier. The (final) material-metallurgical bond between metal foam and solid metal material is achieved at their mutually adjacent bonding surfaces by melting them while foaming the foamable mixture with the addition of heat. However, most of the metallurgical bond between the foamable mixture and the solid metal is already present in the semi-finished product: for example, by forming the foamable mixture or the core and the cover layers, oxide-free surfaces can be created which cause the powder particles of the foamable mixture and the solid material of the cover layer(s) to bond, i.e. a kind of welding takes place. Such a bond can also be achieved by pre-compression prior to forming or by compression without forming, such as by axial pressing of a planar semi-finished product.

In order to achieve a good mechanical load-bearing capacity, in particular good strength and/or torsional stiffness of the composite material comprising a metal foam, the metal foam is formed with closed pores. The closed, spherical pores thus sought enable an optimum load transmission via the cell walls surrounding the pores and as intact as possible, and thus make a substantial contribution to the strength of the metal foam and thus also of the composite material comprising the metal foam.

A metal foam is closed-pored if the individual gas volumes therein, in particular two mutually adjacent gas volumes, are separated from one another by a separating solid phase (wall) or are connected to one another at most by small openings (cracks, holes) caused by the manufacturing process, the cross-sections of which are small in relation to the cross-section of the solid phase (wall) separating two gas volumes in each case.

According to the invention, the semi-finished product is preferably suitable for the production of a composite material comprising a substantially closed-pore metal foam. The substantially closed-pore metal foam is characterized in that the individual gas volumes are connected to each other at most by small openings (cracks, holes) caused by the manufacturing process, but their cross-section is small in relation to the cross-section of the solid phase separating the volumes.

An advantage of the unfoamed semi-finished product according to the invention is its shelf life over a longer period of time, which makes it possible to produce the end product, here a metal foam or composite material containing such a metal foam, quickly and easily if required. For this purpose, the semi-finished product itself has a foamable core, which in turn forms a precursor or primary material for the metal foam core available after foaming. For this purpose the foamable core contains or comprises a foamable mixture comprising the at least one first metal, the at least one foaming agent and optionally at least one auxiliary material or consists exclusively of these components. Preferably the foamable mixture consists exclusively of the at least one first metal and the at least one foaming agent.

The foamable core is produced by powder metallurgy, i.e. it contains or comprises a foamable mixture which, at least at the beginning of the production process, is in the form of powder comprising powder particles. The finished semi-finished product may also contain the foamable mixture in powder form, but the foamable mixture is preferably present in the finished semi-finished product in compressed, in particular pre-compressed form. The (pre-)compression of the powder leads to its solidification and may even lead to a metallurgical bonding of the powder particles to each other, i.e. the individual grains or particles of the powder (powder particles) are partially or completely bonded to each other by means of diffusion and formation of (first) intermetallic phases within the mixture instead of forming a loose powder. This (first) metallurgical bonding has the advantage of a more stable and more compact foamable core, which forms almost no defects in the foam during foaming. The first metallurgical bonding also produces a stable rolling ingot, i.e. the formability of the semi-finished product, especially by rolling, bending, deep drawing and/or hydroforming, is improved. Furthermore, the first metallurgical bonding partially bonds the powder particles to the cover layers.

The powder consists of powder particles which can have a grain size from approximately 2 μm to approximately 250 μm, preferably from approximately 10 μm to approximately 150 μm. These grain sizes have the advantage that a particularly homogeneous mixture, i.e. a particularly homogeneous foamable mixture is formed, so that defects that would otherwise occur later during foaming are avoided.

The foamable (expandable) mixture comprises at least one first metal with an aluminum content of at least 80 wt. % and at least one foaming agent. Preferably, the foamable mixture comprises exactly one first metal with an aluminum content of at least 80 wt. % and exactly one foaming agent. The foamable mixture may further comprise auxiliary materials. Preferably, however, the foamable mixture advantageously does not contain any auxiliary material, since with one or more auxiliary materials the structure of the foamable mixture and of the foamable core is usually disturbed in such a way that the foamed (expanded) core subsequently obtained therefrom has defects such as inhomogeneities in the foam structure, excessively large pores or bubbles and/or open pores instead of closed pores. Particularly preferably, the foamable mixture contains only exactly one first metal with an aluminum content of at least 80 wt. %, exactly one foaming agent, optionally one or more derivatives of the foaming agent and no further substances or auxiliary agents. One or more derivatives of the foaming agent are particularly suitable if the foaming agent is selected from the group of metal hydrides; in this case the foaming agent may additionally comprise as derivative(s) at least one oxide and/or oxyhydride of the metal of the metals of the metal hydride(s) used in each case. Such oxides and/or oxyhydrides are formed during a pretreatment of the foaming agent and can improve its durability as well as its response during foaming, i.e. the time of release of the foaming gas, so that the foaming agent(s) used do not release the foaming gas too early, but also not too late; an early or late release of the foaming gas in this case may produce oversized cavities and thus defects in the metal foam.

The terms "first metal" and "second metal" are herein understood to mean both a pure metal, i.e. aluminum, and a metal alloy, i.e. an alloy of the aluminum, with the first metal and the second metal not being identical, i.e. the two metals differing at least in one alloying constituent, the mass fraction or the weight fraction of at least one alloying constituent and/or in their nature (powder versus solid solid), so that the solidus temperature of the at least one second metal is higher than the liquidus temperature of the at least one first metal. In particular, however, the solidus temperature of the at least one second metal is higher than the liquidus temperature of the foamable mixture.

Due to the nature of the at least one second metal as a solid, non-foamable material compared with the at least one first metal as a powder, in particular pre-compressed powder, it usually has a melting behavior different from that of the at least one first metal, i.e. the same metal or metal alloy as solid material, at the same temperature, begins to melt later than in the form of powder due to a higher melting enthalpy. However, solid material also may only begin to melt at a slightly higher temperature than when it is present as (pre-)compressed powder in particular, especially when the latter is also mixed with a foaming agent, because this lowers the melting point of the mixture of metal powder and foaming agent, i.e. the foamable mixture as a whole.

It is advantageous for the composite material that the solidus temperature of the at least one second metal is higher than the liquidus temperature of the at least one first metal, in particular higher than the liquidus temperature of the foamable mixture. It is also advantageous if the at least one second metal begins to melt so much later (i.e. sufficiently late) as compared to the at least one first metal that the at least one layer (cover layer, top layer), preferably exactly two layers or metallic cover layers, produced from the at least one second metal in solid, non-foamable form does not melt or does not begin to melt when the foamable mixture is foamed. It has been found that otherwise, when the at least one layer melts during the foaming process, it deforms unintentionally, in particular under the pressure of the gas released from the foaming agent. If the at least one second metal begins to melt during the foaming of the at least one first metal, it mixes with the at least one first metal beyond the boundary layers and destroys the foam or does not allow it to form at all or is itself foamed, so that the foaming process becomes completely uncontrollable.

The difference between the solidus temperature of the at least one second metal and the liquidus temperature of the at least one first metal required for this purpose depends on the one hand on the (chemical) nature of the metals or metal alloys selected for the at least one first metal and the at least one second metal and on the other hand on their melting behavior. Advantageously, the at least one second metal has a solidus temperature which is at least approximately 5° C. higher than the liquidus temperature of the foamable mixture. According to the invention, this higher solidus temperature and/or the sufficiently late start of melting of the at least one second metal can be realized with the shape or nature of the at least one second metal (as a solid material compared to a powder form of the at least one first metal), i.e. a shape or nature which causes a higher solidus temperature and/or higher melting enthalpy (since metal in powder form melts earlier and has a lower solidus temperature than solid metal in solid material form); and/or in that the at least one second metal has fewer alloying constituents than the at least one first metal and/or has at least one identical alloying constituent with a lower mass fraction in the alloy than (compared with) the at least one first metal (i.e. the mass fraction of the identical alloying constituent in the at least one first and at least one second metal is lower or smaller in the at least one second metal than in the at least one first metal).

Since the same metal aluminum with an aluminum content of at least approximately 80 wt. % is used as the main component for both the core and the at least one layer (top layer, top layer), the different melting, solidus and/or liquidus temperatures can be adjusted accordingly by different alloy additions in powder and solid material.

Preferably the solidus temperature of the at least one second metal is at least approximately 5° C. higher than the liquidus temperature of the at least one first metal. Depending on the metal or metal alloy, the solidus temperature of the at least one second metal is more preferably at least approximately 6° C., still more preferably at least approximately 7° C., still more preferably at least approximately 8° C., still more preferably at least approximately 9° C., still more preferably at least approximately 10° C., still more preferably at least approximately 11° C., still more preferably at least approximately 12° C., still more preferably at least approximately 13° C., still more preferably at least approximately 14° C., still more preferably at least approximately 15° C., still more preferably at least approximately 16° C., still more preferably at least approximately 17° C., still more preferably at least approximately 18° C., still more preferably at least approximately 19° C. and still more preferably at least approximately 20° C. higher than the liquidus temperature of the at least one first metal. In any case, with the difference between the solidus temperature of the at least one second metal and the liquidus temperature of the at least one first metal, it must be ensured that in the foaming process, which can be carried out later with the semi-finished product, the cover layers applied to the core, consisting of the at least one second metal, do not soften or begin to melt or melt to such an extent that undesirable bulges, dents, cracks, holes and similar defects are created in the cover layers due to the foaming gas formation and/or expansion and/or the cover layers partially or completely melt with the (foamed) core and/or mix with each other. Typically, the solidus temperature of the at least one second metal should be at least approximately 5° C. higher, preferably approximately 10° C. higher and particularly preferably approximately 15° C. higher than the liquidus temperature of the at least one first metal; in special cases the solidus temperature of the at least one second metal is at least approximately 20° C. higher than the liquidus temperature of the at least one first metal. In particular, it has been found surprisingly that a solidus temperature of the at least one second metal which is approximately 15° C. higher than the liquidus temperature of the at least one first metal generally provides a good compromise between the strength of the metal foam structure and the cover layers on the one hand and the quality of the composite structure, i.e. clear phase boundary between metal foam and cover layers and no fusing of metal foam and cover layers on the other hand. The solidus temperature of the at least one second metal is very particularly preferably higher than the liquidus temperature of the foamable mixture by the temperature indicated above. A typical melting range of the at least one first metal is for example from 565° C. to approximately 590° C. and of the at least one second metal is from approximately 605° C. to approximately 660° C.

In a preferred embodiment, the at least one first and second metal are not identical. To this end, the at least one second metal has fewer alloying constituents than the at least one first metal; the at least one second metal has, alternatively or additionally to the at least one first metal, at least one identical alloying constituent with a lower mass fraction in the alloy; the higher solidus temperature of the at least one second metal, as indicated herein, compared to the liquidus temperature of the at least one first metal may be achieved hereby. The higher solidus temperature of the at least one second metal relative to the liquidus temperature of the at least one first metal indicated herein has the advantage that a composite material of at least one foamed first metal and at least one second metal in solid form, i.e. in the form of a non-foamable solid material, can be produced therewith, because the at least one second metal does not thereby begin to melt during foaming of the at least one first metal or the foamable mixture.

However, this goal can also be achieved by the nature of the at least one second metal as a (solid, non-foamable) solid material compared to the at least one first metal as a particularly (pre-)compressed powder. The same metal or the same metal alloy begins to melt as a solid material only at a slightly higher temperature than when it is present as a powder that in particular is (pre-)compressed, especially when the latter is also mixed with a foaming agent, because this lowers the melting point of the mixture of metal powder and foaming agent, i.e.

the foamable mixture as a whole. If the at least one second metal were to start to melt when the at least one first metal is foamed, it would mix with the at least one first metal and destroy the foam or would even make foaming impossible or would itself be foamed, such that the foaming process would become completely uncontrollable.

Preferably, the semi-finished product contains, according to the invention, exactly one second metal, i.e. preferably a layer of exactly one second metal in the form of non-foamable solid material and with an aluminum content of at least 80 wt. % is applied to at least one first and one second surface of the core. Solid material in this context is understood to be solid metal which is not foamed and is also not present in powder form.

The metal here can also be a metal alloy. The solid material in the sense of this invention is not foamable (expandable), in contrast to the foamable mixture according to the invention.

The at least one first metal is in particular selected from the group consisting of aluminum, higher-strength aluminum alloys selected from the group consisting of aluminum-magnesium-silicon alloys (6000 series) and aluminum-zinc alloys (7000 series), wherein $AlZn_{4.5}Mg$ (alloy 7020) is preferred, and higher-strength aluminum alloys having a melting point of approximately 500° C. to approximately 580° C., preferably higher-strength aluminum alloys having a melting point of approximately 500° C. to approximately 580° C., which comprise aluminum, magnesium and silicon, more preferably AlSi6Cu7.5, AlMg6Si6 and AlMg4(±1)Si8(±1), even more preferably AlMg6Si6 and AlMg4(±1)Si8(±1), particularly preferably AlMg4(±1)Si8(±1)

The at least one first metal is preferably selected from the group consisting of higher-strength aluminum alloys selected from the group consisting of aluminum-magnesium-silicon alloys (6000 series) and aluminum-zinc alloys (7000 series), wherein among the aluminum-zinc alloys (7000 series) $AlZn_{4.5}Mg$ (alloy 7020) is preferred, and higher-strength aluminum alloys having a melting point of approximately 500° C. to approximately 580° C., preferably higher-strength aluminum alloys having a melting point of approximately 500° C. to approximately 580° C., which comprise aluminum, magnesium and silicon, more preferably AlSi6Cu7.5, AlMg6Si6 and AlMg4(±1)Si8(±1), even more preferably AlMg6Si6 and AlMg4(±1)Si8(±1), particularly preferably AlMg4(±1)Si8(±1).

The at least one first metal can be aluminum or pure aluminum (at least 99 wt. % aluminum), aluminum being preferred, wherein the content of aluminum is from approximately 80 wt. % to approximately 90 wt. %, particularly preferably approximately 83 wt. %, in relation to the at least one first metal. In addition, the at least one first metal can be a higher-strength aluminum alloy. The higher-strength aluminum alloy may be selected from the group consisting of aluminum-magnesium-silicon alloys (6000 series) and aluminum-zinc alloys (7000 series), wherein among the aluminum-zinc alloys (7000 series) AlZn4.5Mg (alloy 7020) is preferred. The at least one first metal can thus be in particular AIZn4.5Mg (alloy 7020). The at least one first metal can be a higher-strength aluminum alloy with a melting point of approximately 500° C. to approximately 580° C.; preferred higher-strength aluminum alloys are AlSi6Cu7.5, AlMg6Si6 and AlMg4(±1)Si8(±1). The at least one first metal may also be a higher-strength aluminum alloy having a melting point of approximately 500° C. to approximately 580° C. and comprising aluminum, magnesium, and silicon or composed solely of these chemical elements. Preferred higher-strength aluminum alloys with a melting point of approximately 500° C. to approximately 580° C. comprising aluminum, magnesium and silicon are AlMg6Si6 and AlMg4(±1)Si8(±1), of which AlMg4(±1)Si8(±1) is particularly preferred.

The indication (±1) in the alloy formulae used herein means that a percentage by mass more or less than indicated may also be present of the chemical element in question. In general, however, there is a correlation between two elements in a formula that are provided with such indications, i.e. if, for example, the first element in the formula that is provided with (±1) has an additional mass percent, then the second element in the formula that is also provided with (±1) has a mass percent less. The formula AlMg4(±1)Si8(±1) thus also comprises, among others, the formulae AlMg5Si7 and AlMg3Si9.

The at least one second metal is in particular selected from the group consisting of aluminum and higher-strength aluminum alloys selected from the group consisting of aluminum-magnesium alloys (5000 series), aluminum-magnesium-silicon alloys (6000 series) and aluminum-zinc alloys (7000 series).

The at least one second metal may be aluminum or pure aluminum (at least 99 wt. % aluminum), aluminum being preferred, wherein the content of aluminum is from approximately 85 wt. % to approximately 99 wt. %, more preferably approximately 98 wt. %, in relation to the at least one second metal. In addition, the at least one second metal can be a higher-strength aluminum alloy. The higher-strength aluminum alloy may be selected from the group consisting of aluminum-magnesium alloys (5000 series), aluminum-magnesium-silicon alloys (6000 series) and aluminum-zinc alloys (7000 series). The at least one second metal may be in particular an aluminum-magnesium alloy (5000 series). The at least one second metal can be in particular an aluminum-magnesium-silicon alloy (6000 series), preferably Al 6082 (AlSi1MgMn). Finally, the at least one second metal can be in particular an aluminum-zinc alloy (7000 series).

The designations "series" and "alloy" followed by a four-digit number are terms commonly used by those skilled in the art to designate certain classes or series of aluminum alloys or a specific aluminum alloy as indicated herein.

The at least one foaming agent according to the invention releases a foaming gas, which serves for foaming the at least one first metal, from a certain temperature, the outgassing temperature of the foaming agent, by way of outgassing or gas separation. If a metal hydride is used as the foaming agent, hydrogen is released as the foaming gas.

With regard to the choice of foaming agent, it has surprisingly been found that the outgassing temperature of the at least one foaming agent should advantageously be equal to or below the solidus temperature of the at least one first metal, in order to later achieve a closed-pore foam free of defects and an optimum result when foaming the core. The outgassing temperature of the foaming agent should, however, lie preferably not more than approximately 90° C., particularly preferably not more than approximately 50° C., below the solidus temperature of the at least one first metal. In any case, the outgassing temperature of the at least one foaming agent is lower than the solidus temperature of the at least one second metal, since the second metal must not enter its solidus range during foaming, i.e. must not start to melt, as already explained herein.

Surprisingly, it has been found that metal hydrides, in particular the metal hydrides mentioned herein, are particularly suitable as foaming agents for foaming metal containing at least approximately 80 weight % (wt. %) aluminum, in particular the metal alloys of the at least one first metal mentioned herein, since no defects occur in the foamed metal in this method. Therefore, a corresponding semi-finished product with one or more metal hydrides as foaming agent has proved to be particularly suitable for foaming the at least one first metal and for producing a corresponding composite material containing a metal foam. The foaming agent according to the invention thus preferably comprises at least one metal hydride, preferably at least one metal hydride selected from the group consisting of TiH2, ZrH2, HfH2, MgH2, CaH2, SrH2, LiBH4 and LiAlH4. The at least one metal hydride is further preferably selected from the group consisting of TiH2, ZrH2, HfH2, LiBH4 and LiAlH4, still further preferably selected from the group consisting of TiH2, LiBH4 and LiAlH4, and particularly preferably it is TiH2. For certain applications, a combination of two foaming agents is particularly suitable, wherein from each of the two groups (a) $TiH_2$, $ZrH_2$ and $HfH_2$; and (b) $MgH_2$, CaH2, SrH2, $LiBH_4$ and $LiAlH_4$ one foaming agent is selected in each case; preferably the combination of $TiH_2$ with a foaming agent selected from the group consisting of $MgH_2$, CaH2, $SrH_2$, $LiBH_4$ and $LiAlH_4$; particularly preferred is the combination of $TiH_2$ with $LiBH_4$ or $LIAlH_4$. Preferably, according to the invention, exactly one foaming agent is used, in particular preferably exactly one metal hydride as foaming agent, further preferably $TiH_2$, $ZrH_2$, $HfH_2$, $LiBH_4$ or $LiAlH_4$, still further preferably $TiH_2$, $LiBH_4$ or $L1AlH_4$, particularly preferably $TiH_2$.

According to the invention, the foaming agent can additionally comprise at least one oxide and/or oxyhydride of the metal or metals of one or more of the used foaming agents, which are formed during the pretreatment of the foaming agent and improve its durability as well as its response during foaming, i.e. the time of release of the foaming gas. The improvement of the response during foaming with respect to the time of release of the foaming gas consists mainly in a shift in the release of the foaming gas or of the outgassing in the late direction, in order to avoid premature outgassing and thus the formation of defects such as bubbles and holes instead of (closed) pores; this is achieved on the one hand by the said oxides and/or oxyhydrides, and on the other hand by the fact that the at least one foaming agent, especially when one or more metal hydrides are used, is under high pressure in the matrix of the semi-finished product, especially in the matrix of the foamable core, after the first and possibly second metallic bonding. A suitable method of pretreating the foaming agent is heat treatment in an oven at a temperature of 500° C. for a period of approximately 5 hours. The oxide is in particular an oxide of the formula $Ti_vO_w$, where v is from approximately 1 to approximately 2 and w is from approximately 1 to approximately 2. The oxyhydride is in particular an oxyhydride of the formula $TiH_xO_y$, where x is from approximately 1.82 to approximately 1.99 and y is from approximately 0.1 to approximately 0.3. The oxide and/or oxyhydride of the foaming agent can form a layer on the grains of the powder of the foaming agent; the thickness of this layer can be from approximately 10 nm to approximately 100 nm.

The quantity of the foaming agent or the total quantity of all foaming agents when using at least two different foaming agents can be from approximately 0.1 weight % (wt. %) to approximately 1.9 wt. %, preferably from approximately 0.3 wt. % to approximately 1.9 wt. %, in each case in relation to the total quantity of the foamable mixture comprising at least the at least one first metal and at least one foaming agent. The quantity of the oxide and/or oxyhydride can be from approximately 0.01 wt. % to approximately 30 wt. %, in relation to the total quantity of the at least one foaming agent.

The outgassing temperature of the at least one foaming agent is in a range from approximately 100° C. to approximately 540° C., preferably in a range from approximately 400° C. to approximately 540° C., particularly preferably in a range from approximately 460° C. to approximately 540° C. For the metal hydrides provided according to the invention, in particular as foaming agents, the outgassing temperature is in each case as follows (outgassing temperature given in round brackets): $TiH_2$ (approximately 480° C.), $ZrH_2$ (approximately 640° C. to approximately 750° C.), $HfH_2$ (approximately 500° C. to approximately 750° C.), $MgH_2$ (approximately 415° C.), $CaH_2$(approximately 475° C.), $SrH_2$(approximately 510° C.), $LiBH_4$(approximately 100° C.) and $LiAlH_4$ (approximately 250° C.).

The "core" is a middle layer or core layer, which as such is located between two other layers, here the cover layers. The core layer and the two cover layers together form a sandwich structure, or sandwich for short. The foamable core of the semi-finished product comprises the at least one first metal, the at least one foaming agent and optionally at least one auxiliary agent. The (later) foamed core of the composite material comprises the at least one first metal predominantly in the form of metal foam as well as at least one decomposition product of the at least one foaming agent which is formed after the outgassing or discharge of the foaming gas during the foaming process, and optionally at least one auxiliary agent or its decomposition product as a result of the foaming method.

The "surface of the core" is understood to be a surface on the outer surface of the foamable or expanded core, i.e. on the surface formed by the foamable mixture or later the foamed core. This includes in particular the surfaces on which the cover layers are located and lateral surfaces or walls which are also covered with a layer, preferably a metal layer, particularly preferably a layer of the at least one second metal.

The two other layers or top layers comprise at least one second metal, preferably exactly one second metal. The top layers particularly preferably consist only or exactly of a second metal and no other metals. The second metals or the second metal of the cover layers are present in the form of solid, non-foamable material which is not foamed later when the foamable core or foamable core layer is foamed and therefore does not assume a porous structure, in contrast to the core.

In order to simplify the production method for the semi-finished product and thus ultimately also the composite material which can be produced from the semi-finished product, the first and second surfaces defining the core and having the cover layers are formed by a container, i.e. the inserted container, which for this purpose has two surfaces which are preferably plane-parallel, and between the surfaces has an intermediate space for receiving the foamable mixture for forming the core layer.

In addition, the container has further, outer or lateral surfaces in the form of side walls which delimit the intermediate space on the other sides in order to prevent the foamable mixture from trickling out. These lateral surfaces can advantageously be formed from a layer of the same material as the cover layers, in order to simplify manufacture. The container has at least one opening in the unfilled state, preferably in at least one of the two side walls. Preferably, at least two openings are provided, preferably in the side walls. These may be connected to pipes which can be closed to open or close the container. The side walls particularly preferably have a buckling in the direction of the interior of the container of the invention, i.e. towards the foamable mixture, approximately centrally and parallel (i.e. in the case of an arcuate buckling approximately in the region of a minimum) to a longitudinal edge of the cover layers, which buckling may also be arcuate. This buckling makes it possible, in the case of pre-compression, in particular by rolling, to achieve a second metallurgical bond, as described below, so that the container does not open. The buckling, i.e. the internal angle between the two partial surfaces of the side wall, if it is not arcuate, preferably has an angle in a range between approximately 110° and approximately 178°, preferably in a range from approximately 160° to approximately 176°. In the case of an inwardly directed arcuate configuration of the side walls, this arc has a radius in a range from approximately 200 mm to approximately 600 mm. The side walls are preferably multi-layered, preferably at least triple-layered. This further facilitates pre-compression, especially according to step (VII) as described below. The present invention also relates to a container having two cover layers and at least two opposing side walls which are formed with a buckling, as described above. Preferably all side walls have a buckling, as described above.

The lateral surfaces contain at least one opening, preferably two openings for filling in the at least one first metal, the at least one first foaming agent, as applicable the at least one auxiliary material and/or the foamable mixture. This at least one opening is closed after filling the container in step (IV) for the further production process of the semi-finished product, so that the foamable mixture which has been filled in cannot escape. The closing of the opening of the container can be carried out by a method selected from the group consisting of inserting a plug, attaching a closable flange, welding, attaching a metal pipe and subsequently pressing the pipe completely together at one, two or more points of the tube, in particular pressing it together completely in the form of one, two or more notches or press seams, wherein in the case of two or more notches or press seams these are designed to be spaced apart from one another, pressing or rolling of the entire filled container and similar methods, as well as combinations thereof.

At least the first and second surfaces of the container are each formed by a layer or wall as a cover layer or top layer (for the foamable core and later foamed core) of the at least one second metal. However, in order to simplify manufacture, the remaining lateral surfaces of the container may also advantageously be formed by walls of the same at least one second metal. Thus, all external surfaces of the container are preferably made of walls made of the at least one second metal. Particularly preferably, the entire container is made of the at least one second metal, and weld seams may consist of the one second metal or a metal similar to the second metal. The surfaces and/or side walls of the container may be arranged at any angle to each other as long as the first and second surfaces are plane-parallel or substantially plane-parallel to each other. For this purpose, the container may have the shape of a box, a cylinder, in particular a flat cylinder with a height less than the diameter of the cylinder, a prism or a polygonal body.

In the case of a box, the first and second surfaces of the container are formed by the rectangular or square boundary surfaces on the top side and bottom side of the crate. In the case of a cylinder, the first and second surfaces of the container are formed by the circular or elliptical boundary surfaces at the two ends of the cylinder. In the case of a prism, the first and second surfaces of the container are formed by the triangular boundary surfaces at the two ends of the cylinder. In the case of a polygonal body, the first and second surfaces of the container are formed by the polygonal boundary surfaces at the two ends of the polygonal body. The cover layer applied to the first and second surfaces accordingly has the shape (outline) of the first and second surfaces respectively, i.e. a rectangular, square, circular, elliptical, triangular or polygonal shape; however, a substantially square or rectangular shape is preferred. The container thus preferably has a box shape, particularly preferably the shape of a flat box, in which the height, i.e. the distance between the surfaces of the first and second surfaces, is less than the width and depth, i.e. the distances between the surfaces of the lateral surfaces of the box, the flat box possibly having in particular the shape of a plate.

Preferably, the at least one first surface of the container is arranged opposite the at least one second surface of the container. The at least one first surface of the container preferably runs substantially plane-parallel to the at least one second surface of the container. The foamable core is preferably formed as a layer between the at least one first and second surface of the container.

The walls of the container which form the first and second surfaces of the container and thus the cover layers normally have a thickness or thickness or fatness of approximately 20 mm to approximately 200 mm, preferably from approximately 50 mm to approximately 100 mm. The walls of the container which form the remaining side faces or side walls of the container are normally of a thickness or fatness of from approximately 5 mm to approximately 50 mm, preferably from approximately 10 mm to approximately 30 mm.

The at least one first metal is provided in the form of a powder. The powder naturally comprises powder particles, i.e. metal particles which are ground so finely that the structure of the core is as homogeneous as possible without defects, so that no defects are created later either during foaming, in order to obtain the desired closed-pore metal foam. The powder particles of the at least one first metal therefore advantageously have a granularity or grain size, i.e. particle diameter from approximately 2 μm to approximately 250 μm, preferably from approximately 2 μm to approximately 200 μm, more preferably from approximately 10 μm to approximately 150 μm.

The at least one foaming agent is also provided in the form of a powder. The powder naturally comprises powder particles, i.e. particles of the foaming agent, which are ground so finely that the structure of the core is as homogeneous as possible without defects and is mixed with the powder particles of the at least one first metal as completely as possible, so that the first metal can be foamed as completely as possible later during foaming and no defects are produced during foaming either, in order to obtain the desired closed-pore metal foam. The powder particles of the at least one foaming agent therefore advantageously have a granularity or grain size of from approximately 5 μm to approximately 20 μm.

In order to achieve the above-mentioned structure of the core, which is as homogeneous as possible without defects, the powder of the at least one first metal is advantageously furthermore mixed with the powder of the at least one foaming agent to form the foamable mixture. Preferably the mixing or blending of the at least one first metal and at least one foaming agent is carried out before filling the container, i.e. before step (IV), or during the filling of the container, i.e. during step (IV), in each case with the at least one first metal and the at least one foaming agent. In the former case, the foamable mixture is produced by mixing a powder of each of the at least one first metal and the at least one foaming agent before filling the container; in the latter case the foamable mixture is formed during the filling process by adding the powders of the at least one first metal and the at least one foaming agent together and in the correct mixing ratio into the container. Mixing during the filling of the container, i.e. during step (IV), has the advantage that a separate method step for mixing is saved, so that the method as a whole requires even fewer steps and can therefore be carried out more economically.

The method according to the invention may additionally comprise a step of (V) drying (V.1) of the powder of the at least one first metal before step (IV) and/or the powder of the at least one foaming agent before step (IV), or (V.2) of the foamable mixture before step (IV), or (V.3) of the foamable mixture and the container after step (IV).

In step (V.1) the drying of the powder of the at least one first metal may be carried out alternatively or additionally before step (II). In step (V.1) the drying of the powder of the at least one foaming agent may be carried out alternatively or additionally before step (III). Drying is carried out by methods known to a person skilled in the art such as heating, in particular to a temperature of approximately 100° C. to approximately 450° C., preferably at a temperature in a range of approximately 200° C. to approximately 370° C., more preferably to approximately 300° C., with removal of moisture by suction, by desiccants or combinations thereof. Heating or removal of the moisture by suction is preferred. Heating with removal of the moisture by suction is particularly preferred. Drying has the advantage that no steam bubbles of water vapor and corresponding defects can form during foaming.

Furthermore, the method according to the invention can additionally comprise a step (VI) of first metallurgically bonding the powder particles of the foamable mixture to each other and/or to the one layer of the second metal on each of the first and second surfaces of the core to form the foamable core according to step (IV) or (V).

The term "first metallurgical bonding" is understood as follows in accordance with the invention: bonding of the powder mixture and the cover layers by means of diffusion and formation of first intermetallic phases within the mixture. The first metallurgical bonding has the advantage of a more stable and more compact foamable core, which forms almost no defects in the foam during foaming. The first metallurgical bonding produces a stable rolling ingot. Furthermore, the powder particles are partially bonded to the cover layers.

The first metallurgical bonding in step (VI) can be achieved in particular by pre-compressing the foamable mixture together with the container (vessel) under application of pressure in a range from approximately 0.05 MPa to approximately 1.5 MPa, preferably in a range from approximately 0.1 MPa to approximately 1.1 MPa, and even more preferably in a range from 0.15 MPa to approximately 0.45 MPa, and at a temperature of the foamable mixture and the container of approximately 400° C. to approximately 490° C. or of approximately 65% to approximately 90%, preferably approximately 70% to approximately 85%, in particular approximately 80%, of the solidus temperature of the foamable mixture or of the at least one first metal. The duration (holding time) may be from approximately 4 h to approximately 48 h, preferably from approximately 6 h to approximately 32 h, preferably up to approximately 24 h. In particular, the semi-finished product can be heated to approximately 80% of the melting temperature of the foamable mixture and kept at this temperature for approximately 6 hours to approximately 32 hours, preferably up to approximately 24 hours. Preferably, pressure should be applied vertically to the first and second surfaces of the container, i.e. vertically to the cover layers, with the first and second surfaces or the cover layers being arranged substantially plane-parallel to one another. Pressure can be applied here in a pressing process using two plane-parallel tools, for example a table with a horizontal plate that can be moved on it. With regard to the temperature during pre-compression, a temperature of the foamable mixture and the container of approximately 65% to approximately 90%, preferably approximately 70% to approximately 85%, in particular approximately 80% of the solidus temperature of the foamable mixture, is preferred.

The pre-compression of the container (vessel) can be carried out in a pressing process using two plane-parallel tools. In this process, the powder is pre-compressed at a pressure in a range from approximately 0.05 MPa to approximately 1.5 MPa, preferably in a range from approximately 0.1 MPa to approximately 1.1 MPa, and even more preferably in a range from 0.15 MPa to approximately 0.45 MPa, and at a temperature in a range from approximately 400° C. to approximately 490° C., preferably up to approximately 470° C., more preferably up to approximately 460° C., or at approximately 65% to approximately 90%, preferably approximately 70% to approximately 85%, in particular approximately 80%, of the solidus temperature of the foamable mixture or of the at least one first metal. Preferably, the powder is pre-compressed at approximately 65% to approximately 90%, preferably approximately 70% to approximately 85%, in particular approximately 80%, of the solidus temperature of the foamable mixture or of the at least one first metal. The pressing process can be carried out in particular if the container is in an air atmosphere at ambient air pressure. This eliminates the need for an inert gas atmosphere or the application of vacuum and/or working under vacuum. The pre-compression, which is preferably carried out by axial pressing, produces a stable rolling ingot. Furthermore, the powder particles are partially bonded to the cover layers of the container.

Alternatively, and in the sense of the present invention, the first metallurgical bonding in step (VI) can be performed in particular preferably by heating the foamable mixture and the container to approximately 70% to approximately 90%, preferably approximately 75% to approximately 85%, preferably approximately 80%, of the solidus temperature of the foamable mixture, wherein expansion of the container is largely prevented. Preferably, the temperature is in a range from approximately 450° C. to approximately 495° C., even more preferably in a range from approximately 455° C. to approximately 465° C. The duration (holding time) is approximately 4 h to approximately 48 h, preferably approximately 6 h to approximately 32 h, more preferably up to approximately 24 h, still more preferably approximately 24 h to approximately 32 h. In particular, the container can be heated to approximately 80% of the melting point of the foamable mixture and kept at this temperature for approximately 6 hours to approximately 24 hours. This can be done in particular at ambient air pressure. This saves the expense of an inert gas atmosphere or the application of vacuum and/or working under vacuum. With this alternative design, the container can be effectively prevented from expanding by devices known to a person skilled in the art, such as vices, clamps, weights and/or a correspondingly dimensionally stable and rigid holding frame, which in each case or in combination force the container to remain in its original shape. The holding frame may also be a kind of mold, similar to a casting mold. Furthermore, expansion of the container can be prevented by axial pressing, in particular by one or more presses, preferably perpendicular to the cover layers, which are fed in from two or more sides of the container or along one or more axes of the container before step (VI) without compressing the container. The applied pressure is preferably in a range of approximately 0.15 MPa to approximately 0.6 MPa, more preferably in a range of approximately 0.2 MPa to approximately 0.4 MPa. The (premature) outgassing of the foaming agent in step (VI) is prevented by the pre-compression of the foamable mixture, either by the application of externally generated pressure or by the pressure generated by preventing the container from expanding inside.

The method according to the invention may additionally comprise a step (VII) of second metallurgical bonding of the foamable core obtained in step (VI) to the layers of the at least one second metal on the first and second surfaces of the container.

According to the invention, the term "second metallurgical bonding" is understood to mean the production of oxide-free surfaces by forming of the core and the cover layers, which causes the powder particles and the cover layers to bond, i.e. a type of welding takes place. The second metallurgical joining allows a simple procedure for bonding, since, for example, no individual weld seams have to be applied, and since it also produces a more stable bond than can be achieved, for example, with adhesive, which would not survive the temperatures occurring during subsequent foaming without sustaining damage.

According to the invention, the second metallurgical bonding can be achieved by processes comprising diffusion and rolling, but also axial or hydrostatic pressing, with rolling being preferred, under the action of pressure on the container. In a rolling process, the pressure in the roll gap is preferably in a range from approximately 5000t to approximately 7000t, more preferably in a range from approximately 5600t to approximately 6500t. The temperature of the container is below the outgassing temperature of the at least one foaming agent, below the solidus temperature of the foamable core and below the solidus temperature of the at least one second metal. Preferably the temperature during the second metallurgical bonding is from approximately 400° C. to approximately 520° C., preferably from approximately 440° C. to approximately 510° C., still more preferably in a range from approximately 470° C. to approximately 500° C., the temperature here always having to be below the outgassing temperature of the at least one foaming agent so that there are no bubbles in the rolled material. In particular, the second metallurgical bonding may be carried out by hot rolling the container at a temperature below the decomposition temperature of the foaming agent. A cold rolling process may then follow, preferably to achieve sheet thicknesses below 9 mm.

By means of the rolling process or other techniques such as axial pressing or hydrostatic pressing, in each case in the specified temperature ranges, a second metallurgical bonding between powder and cover layer is achieved, and the powder of the foamable mixture is furthermore compacted to approximately 90% to approximately 100% of its nominal density. The "nominal density" of the foamable mixture is the density that the foamable mixture would have if it were not in powder form, but instead in compact form as a solid material. The resulting triple-layer sheets are then finished and, if necessary, fed to the foaming method. The container can be opened wide enough to allow any gases produced to escape during heating for the first and/or second metallurgical bonding in steps (VI) and/or (VII). The container remains closed between the first and second metallurgical bonding. In addition, the container may be opened sufficiently wide to allow any gases produced to escape during the first and/or second metallurgical bonding in steps (VI) and/or (VII). In particular, the container can be opened sufficiently wide for gases created to escape during heating for the rolling process and during the rolling operation in step (VII). The advantage of this is that no gases are trapped during the rolling process and, above all in the case of thin sheet thicknesses, do not lead to gas-filled dents even before the foaming process.

The method according to the invention provides an unfoamed semi-finished product that can be stored for practically unlimited periods of time without any disadvantages later on in the foaming process, i.e. during the production of a foamed composite material from the semi-finished product. In particular, this prevents aging and premature outgassing of the foaming agent. In the semi-finished product according to the invention, the foamable core can be formed as a layer between the two layers of the at least one second metal. As already mentioned herein, the powder particles of the foamable mixture may be present in powder form in the semi-finished product, but are preferably compressed by the first and second powder metallurgical bonding. The powder particles are particularly preferably consolidated. It is very particularly preferred that the (consolidated) powder particles are partially or almost completely metallurgically bonded to each other, especially completely: The individual grains or particles of the powder (powder particles) are partially or completely bonded to each other by means of diffusion and formation of (first) intermetallic phases within the mixture instead of forming a loose powder. This has the advantage of a more stable and more compact foamable core, which forms almost no defects in the foam during foaming. In addition, the first and second metallurgical bonding improves the formability of the semi-finished product, especially by rolling, bending, deep drawing, hydroforming and hot pressing, as well as the strength of the bond between the foamed core and the cover layer, thus avoiding material fatigue.

In the semi-finished product according to the invention, the foamable core is preferably metallurgically bonded to the layers of the at least one second metal, which permits a simple procedure for bonding, since, for example, no individual weld seams have to be applied, and since it also results in a more stable connection than, for example, by adhesive bonding, especially with regard to the elevated temperatures required for later foaming of the foamable core. The metallurgical bonding of the foamable core to a layer of the second metal on one surface of the container can be achieved by a method selected from the group consisting of rolling and diffusion, but also axial or isostatic pressing, at elevated temperatures. The bond achieved by the (second) metallurgical bonding between the foamable core and the at least one second metal is so strong that it also withstands the elevated temperatures of the foaming process for which the semi-finished product is manufactured. The semi-finished product according to the invention can be used for foaming metal, i.e. for producing a metal foam. In particular, the semi-finished product is suitable for use in the production of a composite material comprising metal foam and metal in the form of non-foamable solid material.

In a special embodiment of the invention, the filled container is heated to a temperature of approximately 300° C. and the moisture is removed in one process step. Subsequently, the container is either pre-compressed at a temperature of approximately 400° C. to approximately 460° C., preferably with external pressure application, in particular by axial pressing, with a pressure in a range of approximately 0.2 MPa to approximately 1.5 MPa, preferably with a pressure in a range of approximately 0.2 MPa to approximately 1.1 MPa, or is heated to 80% of the solidus temperature of the core material (the foamable mixture) in a device which prevents expansion of the container. Both methods also serve to increase the stability of the container for the subsequent rolling process. Furthermore, the container structure prevents the metal powder or powder mixture from trickling out. This process step ensures that the powder spillage is compacted, the aluminum powder is bonded to the cover layers by diffusion, and thus the bond has a higher shear strength for the subsequent rolling. The container is then opened wide enough to allow gases to escape during heating for the rolling process and during the rolling operation. The opening may be effected by removing plugs or the like from at least two side openings in the container. The resulting composite may be shaped and/or foamed directly by heating.

The invention shall be further explained by means of the drawings or figures listed and described below, from which further advantageous embodiments of the invention may be deduced, without, however, necessarily limiting the invention or individual features of the invention. Rather, features described there may be combined with each other and with the features described above to form further embodiments of the invention.

FIG. 1 is an illustration of the container and shows the box-shaped container lower part, consisting of base (3) and side walls (1), and the lid (3). Base and lid (3) form the layers or cover layers or top layers made of the at least one second metal (cover layer material), which later cover the foamable core. The filling holes or openings (2) are used for filling the foamable mixture and, if necessary, escape of gases during the first and/or second metallurgical bonding during steps (VI) and (VII).

Figure 2:
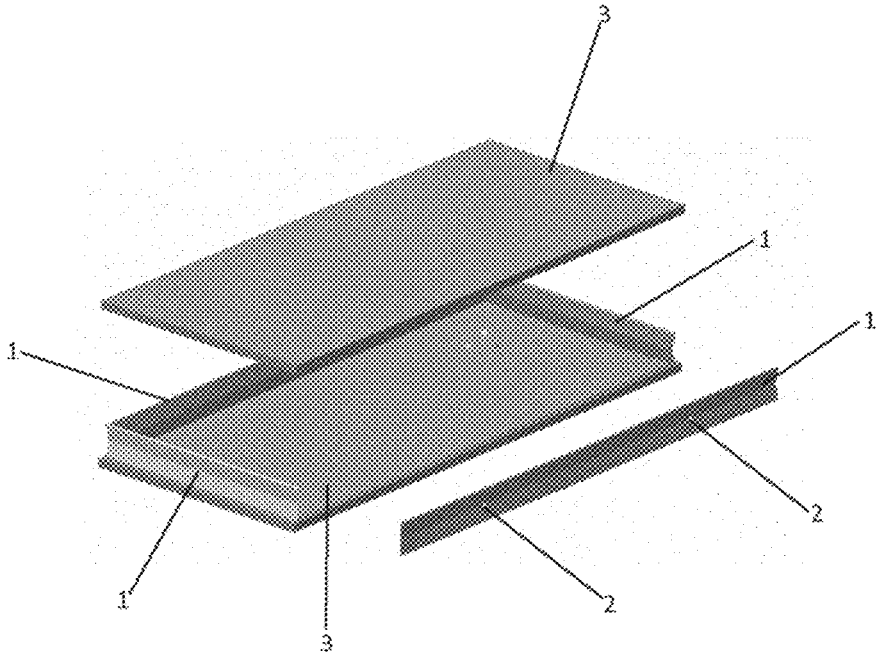

FIG. 2 is a representation of the container in an exploded drawing and also shows the side walls (1), which have a buckling of approximately 175°, filling holes or openings (2) and base and lid (3) as (subsequent) top layers or cover layers.

The invention will be explained in more detail on the basis of the exemplary embodiments described below, without necessarily limiting the invention or individual features of the invention.

EXAMPLE 1

The following method steps were used to produce the foamable semi-finished product for the production of aluminum foam sandwich structures. First, the powder mixture (foamable mixture) was produced. For this purpose, 0.4 to 1.0 wt. % $TiH_2$ in powder form (weight % in relation to the aluminum alloy) was mixed with a powder of the aluminum alloy AlSi8Mg4 as the first metal. This powder mixture was then filled into an aluminum container of the alloy Al 6082 (AlSi1MgMn) as the second metal, in which two opposite walls formed the later cover layers of the triple-layer primary material (semi-finished product), which foams to form a sandwich structure (composite material). The aluminum alloy of the container was selected here so that it had a solidus temperature that was higher than the liquidus temperature of the powder mixture (foamable mixture). After the container was completely filled with the powder mixture, the powder mixture was dried. The powder was heated up to 300° C. and the resulting moisture was removed. The container was then heated to approximately 80% of the solidus temperature of the powder mixture or of the at least one first metal and kept at a temperature of 455° C. for 6 to 24 hours to achieve a first metallurgical bond, and expansion of the container was suppressed. In the following rolling process, the container was hot rolled at a pressure of approximately 6000t in the roll gap at a temperature of approximately 475° C. to obtain a second metallurgical bond. This was followed, if necessary, by another cold rolling process to achieve sheet thicknesses below 9 mm. By means of the rolling process the second metallurgical bond between powder and cover layer was achieved and the powder was furthermore compacted to 98% to 100% of the density of the solid material. The resulting triple-layer sheets were then finished and fed to the foaming process. The above method was also carried out with the following aluminum alloys for the metal in the powder mixture and the container as well as the following foaming agents in the indicated quantities:

| Example | Alloy of the metal of the powder mixture | Foaming agent[1] | Alloy of the metal of the container |
|---|---|---|---|
| 1.1 | AlSi8Mg4 | $TiH_2$ (1.0 wt. %) | Al 6082 |
| 1.2 | AlSi8Mg4 | $TiH_2$ (0.5 wt. %) | Al 5754 |
| 1.3 | AlSi8Mg4 | $TiH_2$ (0.6 wt. %) | Al 5005 |
| 1.4 | AlSi8Mg4 | $TiH_2$ (0.6 wt. %) | Al 6016 |
| 1.5 | AlSi7 | $TiH_2$ (1.2 wt. %) | Al 3103 |
| 1.6 | AlSi6Cu7.5 | $TiH_2$ (0.8 wt. %) | Al 6060 |

[1]The specification of the quantity of foaming agent in weight % (wt. %) is based on the total quantity of the foamable mixture/powder blend. The same method was also carried out with the following foaming agents instead of $TiH_2$: $ZrH_2$, $HfH_2$, $MgH_2$, $CaH_2$, $SrH_2$, $LiBH_4$ and $LiAlH_4$ as well as combinations of $TiH_2$ with $LiBH_4$ and $TiH_2$ with $LiAlH_4$.

EXAMPLE 2

The following method steps were used to produce the foamable semi-finished product for the production of aluminum foam sandwich structures. First, the powder mixture (foamable mixture) was produced. For this purpose, 0.4 to 1.0 wt. % $TiH_2$ in powder form (weight % in relation to the aluminum alloy) was mixed with a powder of the aluminum alloy AlSi8Mg4. This powder mixture was then filled into an aluminum vessel (aluminum container) of the alloy AL 6082 (AlSi1Mg—Mn), in which two opposite walls formed the later cover layers of the triple-layer pre-material (semi-finished product), which foams to form a sandwich structure. The alloy of the aluminum container was selected so that it had a solidus temperature that was higher than the liquidus temperature of the powder mixture (foamable mixture). After the container was completely filled with the powder mixture, the powder mixture was dried. The powder was heated up to 300° C. and the resulting moisture was removed. The container was then pre-compressed for the first time at a pressure of 0.2 MPa using two plane-parallel tools in a pressing process over a period of approximately 28 hours. The powder was pre-compressed at 400° C. to 460° C. The pre-compression produced a stable rolling ingot. Furthermore, the powder particles were partially bonded to the cover layers in a first metallurgical bond. In the following rolling process for the second pre-compression, the vessel was hot rolled at a temperature of approximately 475° C. and a pressure in the roll gap of approximately 6000t. This was followed, if necessary, by a cold rolling process to achieve plate thicknesses below 9 mm. By means of the rolling process a second metallurgical bond between powder and cover layer was achieved and the powder was further compacted to approximately 98% to 100% of its nominal density. The resulting triple-layer sheets were then finished and fed to the foaming method.

The above method was also carried out with the following aluminum alloys for the metal in the powder mixture and the container as well as the following foaming agents in the quantities indicated:

| Example | Alloy of the metal of the powder mixture | Foaming agent[1] | Alloy of the metal of the container |
|---|---|---|---|
| 2.1 | AlSi8Mg4 | $TiH_2$ (1.0 wt. %) | Al 6082 |
| 2.2 | AlSi8Mg4 | $TiH_2$ (0.5 wt. %) | Al 5754 |
| 2.3 | AlSi8Mg4 | $TiH_2$ (0.6 wt. %) | Al 5005 |
| 2.4 | AlSi8Mg4 | $TiH_2$ (0.6 wt. %) | Al 6016 |
| 2.5 | AlSi7 | $TiH_2$ (1.2 wt. %) | Al 3103 |
| 2.6 | AlSi6Cu7.5 | $TiH_2$ (0.8 wt. %) | Al 6060 |

[1]The specification of the quantity of foaming agent in weight % (wt. %) is based on the total quantity of the powder mixture. The same method was also carried out with the following foaming agents instead of $TiH_2$: $ZrH_2$, $HfH_2$, $MgH_2$, $CaH_2$, $SrH_2$, $LiBH_4$ and $LiAlH_4$ as well as combinations of $TiH_2$ with $LiBH_4$ and $TiH_2$ with $LiAlH_4$.

The invention claimed is:

1. A method for producing a semi-finished product comprising a foamable core which comprises a foamable mixture comprising at least one first metal having an aluminum content of at least approximately 80 wt. %, in relation to the quantity of the at least one first metal, and at least one foaming agent, wherein a layer of at least one second metal in the form of non-foamable solid material and having an aluminum content of at least approximately 80 wt. %, in relation to the quantity of the at least one second metal, is applied to each of at least one first and one second surface of the core, the method comprising the steps of (I) providing a container comprising a layer of the at least one second metal on the at least one first and second surfaces of the container, (II) providing a powder comprising powder particles of the at least one first metal, (III) providing a powder comprising powder particles of the at least one foaming agent, and (IV) filling the container with the powders provided in steps (II) and (III) to form the foamable core, wherein the powders provided in steps (II) and (III) are mixed to form the foamable mixture additionally comprising the steps of:

(VI) first metallurgically bonding the powder particles of the foamable mixture to each other and/or to the one layer of the second metal on each of the first and second surfaces of the core to form the foamable core according to step (IV), wherein, in step (VI), either pre-compression of the foamable mixture together with the container is carried out under application of pressure at a temperature of the foamable mixture and of the container of from approximately 65% to approximately 90% of the solidus temperature of the foamable mixture or the foamable mixture and the container are heated to approximately 70% to approximately 90% of the solidus temperature of the foamable mixture, wherein expansion of the container is substantially prevented;

and additionally comprising the step of (VII) second metallurgical bonding of the foamable core obtained in step (VI) to the layers of the at least one second metal on the first and second surfaces of the container, wherein the second metallurgical bonding is carried out by rolling under the action of pressure on the container, wherein the temperature of the container is from approximately 400° C. to approximately 520° C., in each case at a temperature of the container below the outgassing temperature of the at least one foaming agent.

2. The method according to claim 1, wherein the at least one second metal (a) has a solidus temperature which is at least approximately 5° C. higher than the liquidus temperature of the foamable mixture; and/or (b) has fewer alloying constituents than the at least one first metal or has at least one identical alloying constituent with a lower mass fraction in the alloy than the at least one first metal.

3. The method according to claim 1, wherein (a) the at least one first metal is selected from the group consisting of aluminum, higher-strength aluminum alloys selected from the group consisting of aluminum-magnesium-silicon alloys (6000 series) and aluminum-zinc alloys (7000 series), and higher-strength aluminum alloys having a melting point of approximately 480° C. to approximately 580° C.; and/or (b) the at least one second metal is selected from the group consisting of aluminum and higher-strength aluminum alloys selected from the group consisting of aluminum-magnesium alloys (5000 series), aluminum-magnesium-silicon alloys (6000 series) and aluminum-zinc alloys (7000 series).

4. The method according to claim 1, wherein the mixing of the powders provided in steps (II) and (III) to form the foamable mixture is carried out before or during step (IV).

5. The method according to claim 1, wherein the outgassing temperature of the at least one foaming agent is equal to the solidus temperature of the at least one first metal or is below the solidus temperature of the at least one first metal but is not more than approximately 90° C. below the solidus temperature of the at least one first metal and is less than the solidus temperature of the at least one second metal.

6. The method according to claim 1, wherein the at least one foaming agent comprises at least one metal hydride.

7. The method according to claim 6, wherein the at least one foaming agent additionally comprises at least one oxide and/or at least one oxyhydride of the metal of the particular metal hydride.

8. The method according to claim 7, wherein at least one foaming agent is TiH2 and the at least one (a) oxide is an oxide of the formula TivOw, wherein v is from approximately 1 to approximately 2 and w is from approximately 1 to approximately 2, and/or (b) oxyhydride is an oxyhydride of the formula TiHxOy and x is from approximately 1.82 to approximately 1.99 and y is from approximately 0.1 to approximately 0.3.

9. The method according to claim 1, wherein the quantity of the at least one foaming agent is from approximately 0.1 wt. % to approximately 1.9 wt. % in relation to the quantity of the at least one first metal.

10. The method according to claim 7, wherein the quantity of the at least one oxide and/or at least one oxyhydride is from approximately 0.01 wt. % to approximately 30 wt. % in relation to the total quantity of the at least one foaming agent.

11. The method according to claim 1, wherein (a) the at least one first surface of the container and the at least one second surface of the container (a.1) are arranged opposite each other, and/or (a.2) are substantially plane-parallel; and/or (b) the foamable core is formed as a layer between the at least one first and second surface of the container.

12. The method according to claim 1, additionally comprising the step of (V) drying (V.1) of the powder of the at least one first metal before step (IV) and/or of the powder of the at least one foaming agent before step (IV), or (V.2) of the foamable mixture before step (IV), or (V.3) of the foamable mixture and the container after step (IV).

13. The method according to claim 1, wherein the temperature of the container at the beginning of the particular method step is from approximately 400° C. to approximately 540° C.

14. A semi-finished product formed by a method as defined in claim 1.

15. A container for carrying out the method according to claim 1, the container having a first and a second surface forming a base and a lid, and side walls, wherein at least one side wall has an inward buckling in the direction of a foamable mixture.

* * * * *